US007997212B2

(12) United States Patent
Henriott

(10) Patent No.: US 7,997,212 B2
(45) **Date of Patent: *Aug. 16, 2011**

(54) MULTI-PURPOSE TABLE WITH ELECTRICAL FEATURES

(75) Inventor: Jay M. Henriott, Jasper, IN (US)

(73) Assignee: Kimball International, Inc., Jasper, IN (US)

( * ) Notice: Subject to any disclaimer, the term of this patent is extended or adjusted under 35 U.S.C. 154(b) by 612 days.

This patent is subject to a terminal disclaimer.

(21) Appl. No.: 11/754,479

(22) Filed: May 29, 2007

(65) Prior Publication Data

US 2008/0295742 A1 Dec. 4, 2008

(51) Int. Cl.
*A47B 37/00* (2006.01)

(52) U.S. Cl. ..... 108/50.02; 312/223.6

(58) Field of Classification Search ..... 108/50.01, 108/50.02, 6, 7, 115; 312/223.6, 223.3; 248/900, 248/906

See application file for complete search history.

(56) References Cited

U.S. PATENT DOCUMENTS

| | | | | |
|---|---|---|---|---|
| 1,902,424 | A | | 3/1933 | Sherman |
| 1,916,537 | A | | 7/1933 | Smith |
| 3,148,746 | A | | 9/1964 | Juculano |
| 3,227,487 | A | | 1/1966 | Blanchard, Jr. et al. |
| 3,281,184 | A | | 10/1966 | Axtell |
| 3,635,174 | A | | 1/1972 | Ball et al. |
| 3,982,785 | A | | 9/1976 | Ambasz |
| 4,300,371 | A | | 11/1981 | Herwick et al. |
| 4,372,629 | A | | 2/1983 | Propst et al. |
| 4,535,703 | A | * | 8/1985 | Henriott et al. ..... 108/50.02 |
| 4,570,465 | A | | 2/1986 | Bennett |
| 4,688,869 | A | * | 8/1987 | Kelly ..... 439/209 |
| 4,734,826 | A | | 3/1988 | Wilson et al. |
| 4,748,913 | A | | 6/1988 | Favaretto et al. |
| 4,879,954 | A | | 11/1989 | Sawamura et al. |
| 4,941,412 | A | | 7/1990 | Engel |
| 5,129,703 | A | | 7/1992 | Ballendat et al. |
| 5,231,562 | A | | 7/1993 | Pierce et al. |
| 5,282,669 | A | | 2/1994 | Barile |
| 5,318,454 | A | | 6/1994 | Deer et al. |
| 5,336,097 | A | * | 8/1994 | Williamson et al. ..... 439/94 |
| 5,381,685 | A | | 1/1995 | Carl et al. |
| 5,606,919 | A | | 3/1997 | Fox et al. |
| 5,640,912 | A | | 6/1997 | Diffrient |

(Continued)

FOREIGN PATENT DOCUMENTS

EP 0 179 410 11/2008

OTHER PUBLICATIONS

Foreign patent document together with English language abstract.

(Continued)

*Primary Examiner* — Darnell M Jayne
*Assistant Examiner* — Andres Gallego
(74) *Attorney, Agent, or Firm* — Baker & Daniels LLP

(57) ABSTRACT

A multi-purpose table including a channel forming a portion of, or attached to, a horizontal support bar of the table. The channel includes at least one trough for managing cables and cords associated with electrical and communication outlets. The electrical and communication outlets may be provided in the channel. The outlets remain available to a user of the table when a work surface of the table is positioned in either a horizontal or a vertical position.

9 Claims, 4 Drawing Sheets

U.S. PATENT DOCUMENTS

| | | | | |
|---|---|---|---|---|
| 5,709,110 | A | 1/1998 | Greenfield et al. | |
| 5,794,545 | A | 8/1998 | McDaniel et al. | |
| 5,886,295 | A | 3/1999 | Carino et al. | |
| 5,927,214 | A | 7/1999 | Schwartz et al. | |
| 5,971,508 | A * | 10/1999 | Deimen et al. | 312/223.6 |
| 5,971,509 | A * | 10/1999 | Deimen et al. | 312/223.6 |
| 6,202,567 | B1 | 3/2001 | Funk et al. | |
| 6,252,171 | B1 | 6/2001 | Barr | |
| 6,283,043 | B1 * | 9/2001 | Stern et al. | 108/50.02 |
| 6,336,414 | B1 * | 1/2002 | Stewart et al. | 108/50.02 |
| 6,435,106 | B2 | 8/2002 | Funk et al. | |
| 6,637,352 | B1 | 10/2003 | Thode et al. | |
| 6,647,900 | B1 | 11/2003 | Kopish | |
| 6,817,684 | B2 | 11/2004 | Cattaneo | |
| 6,845,723 | B2 | 1/2005 | Kottman et al. | |
| 7,013,685 | B2 | 3/2006 | Francke | |
| 7,066,098 | B2 | 6/2006 | Blasen et al. | |
| 2003/0020381 | A1 * | 1/2003 | Cattaneo | 312/223.6 |
| 2004/0035157 | A1 | 2/2004 | Petrick et al. | |
| 2004/0237854 | A1 * | 12/2004 | Piretti | 108/115 |
| 2005/0028571 | A1 | 2/2005 | Merrem et al. | |
| 2005/0193930 | A1 | 9/2005 | Hartel et al. | |
| 2005/0284341 | A1 | 12/2005 | Klassy et al. | |
| 2006/0081156 | A1 | 4/2006 | Gayhart et al. | |
| 2006/0230991 | A1 | 10/2006 | Piretti | |
| 2008/0295744 | A1 * | 12/2008 | Henriott | 108/50.02 |

OTHER PUBLICATIONS

Canadian Office Action dated Mar. 29, 2010, in corresponding Canadian Application No. 2,631,965.

Office Action dated Oct. 4, 2010 in corresponding U.S. Appl. No. 12/122,099.

* cited by examiner

MULTI-PURPOSE TABLE WITH ELECTRICAL FEATURES

BACKGROUND

1. Field of the Invention

The present invention relates to a multi-purpose table, and in particular to a multi-purpose table having a channel for electrical and communication cable and outlet management purposes.

2. Description of the Related Art

Articles of office furniture, such as tables, are often used in environments which require electrical outlets and/or communication outlets near a work surface, such that a user may plug an electrical cord into the electrical outlet to power a device positioned on or proximate the article of furniture, or may plug a communication cable into the communication outlet to provide service to a device positioned on or proximate the article of furniture. Some municipalities allow articles of furniture to include electrical outlets having power supplied thereto via extension cords plugged into existing outlets in a building or other structure in which the article of furniture is positioned. Other municipalities do not permit such extension cords and instead require that power supplies to the electrical outlets be fully contained and not connected via extension cords.

BRIEF SUMMARY

The present invention provides a multi-purpose table including a channel forming a portion of, or attached to, a horizontal support structure of the table. The channel includes at least one trough for managing cables and cords associated with electrical and communication outlets. The electrical and communication outlets may be provided in the channel. The outlets remain available to a user of the table when a work surface of the table is positioned in either a horizontal or a vertical position. In one embodiment, the outlets are provided with a snap-fit engagement in the channel. In another embodiment, the outlets may be slidably engageable with the channel. In yet another embodiment, the outlets are provided in cutout regions of the channel.

In one form, the present invention provides an article of furniture, including a table including a work surface and a support structure, the work surface pivotable between a horizontal position and a vertical position; a channel disposed beneath the work surface, whereby the channel remains stationary during pivoting of the work surface between the horizontal position and the vertical position; and at least one electrical component removably mounted within the channel.

In another form, the present invention provides a table with a support structure and a work surface, including a trough, the trough configured to removably receive a first electrical component and a second electrical component; wherein the trough includes at least one channel for slidably receiving the first electrical component and the trough includes a pair of flanges for receiving the second electrical component in snap-fitting engagement.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplary embodiments of the invention illustrated herein are not to be construed as limiting the scope of the invention in any manner.

DETAILED DESCRIPTION

Figure 1:
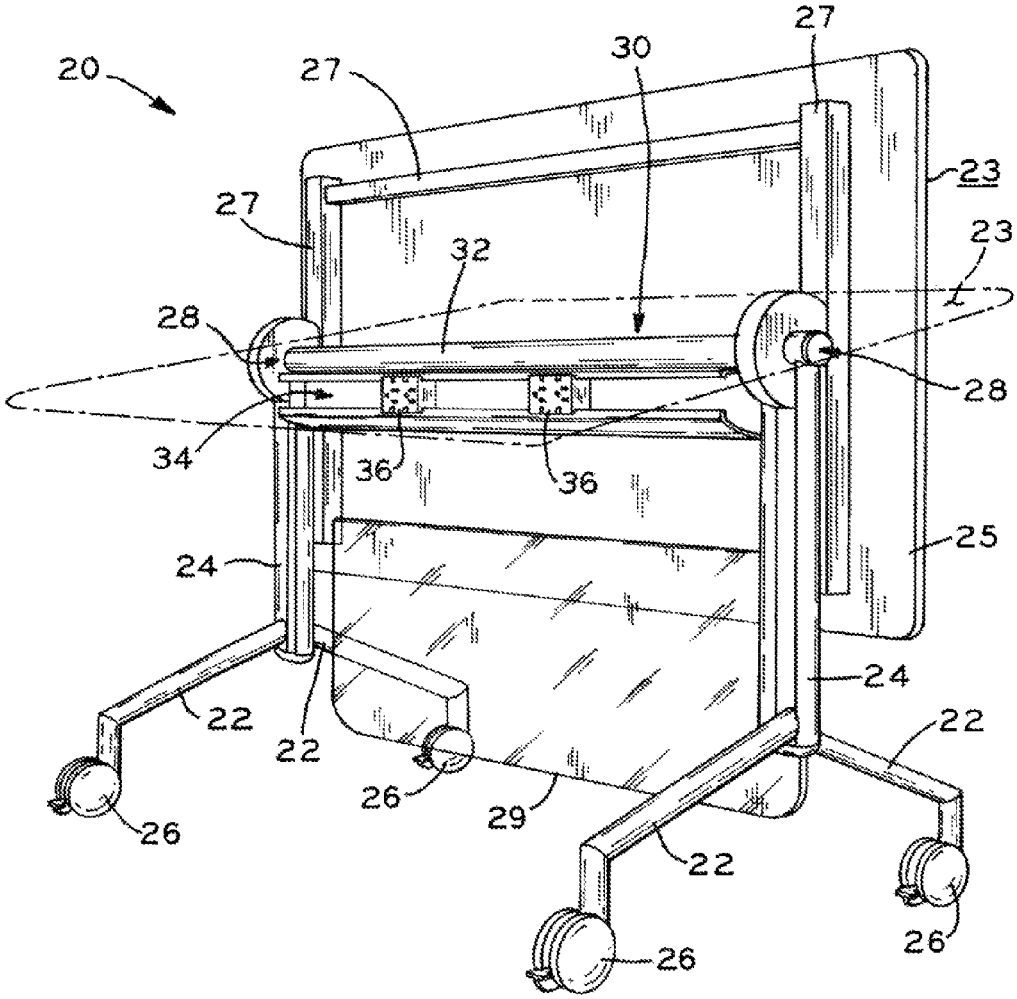
FIG. 1 is a perspective view of a multi-purpose table according to one embodiment of the present invention.

Referring to FIG. 1, multi-purpose table 20 is shown and generally includes a plurality of legs 22, caster wheels 26, and two upright supports 24 for supporting support surface 25. Support surface 25 includes work surface 23 and support structure 27. Support structure 27 may be attached to rotation mechanisms 28 positioned generally at each end of table 20. Rotation mechanisms 28 are provided to permit rotation of work surface 23 between a generally vertical position, as shown in solid lines in FIG. 1 and a generally horizontal position, as shown in dashed lines in FIG. 1, thereby facilitating storage and movement of table 20. Rotation mechanisms 28 are commercially available from OMT/Veyhl of Zwerenberg, Germany. Table 20 further includes channel 30 including cross bar 32 and trough 34 for housing and maintaining snap-in electrical module 36, communication module 37 (FIG. 3A), and optionally a plurality of various cords and cables 48 (FIG. 3) associated with the modules. Cross bar 32 may form a horizontal support rod or structure between two upright supports 24 of table 20.

Figure 2:
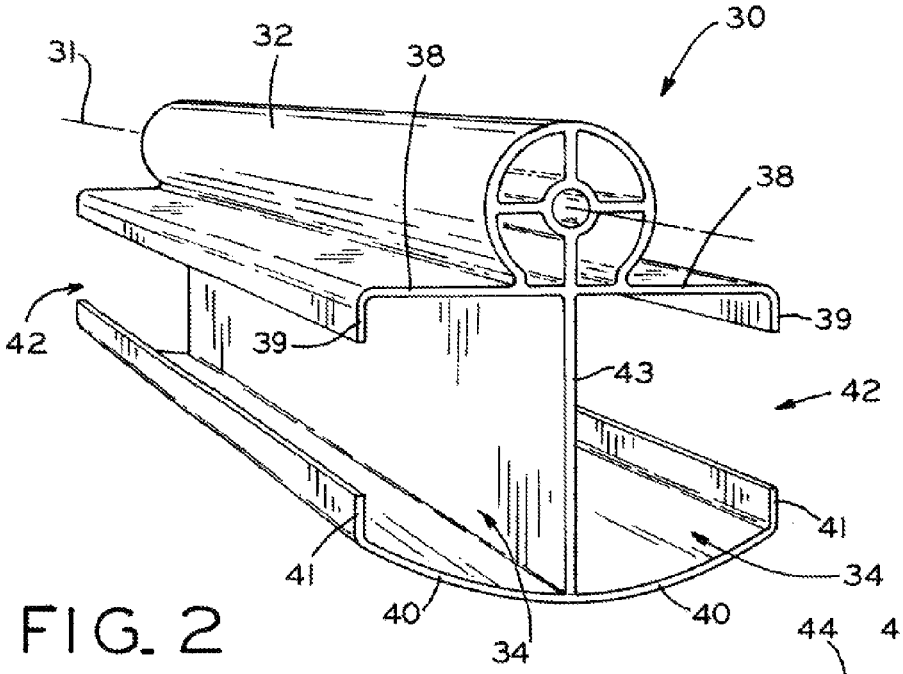
FIG. 2 is a perspective view of the channel of the table shown in FIG. 1.
Figure 3A:
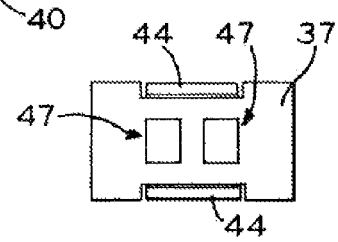
FIG. 3A is a view of a data services module.
Figure 3:
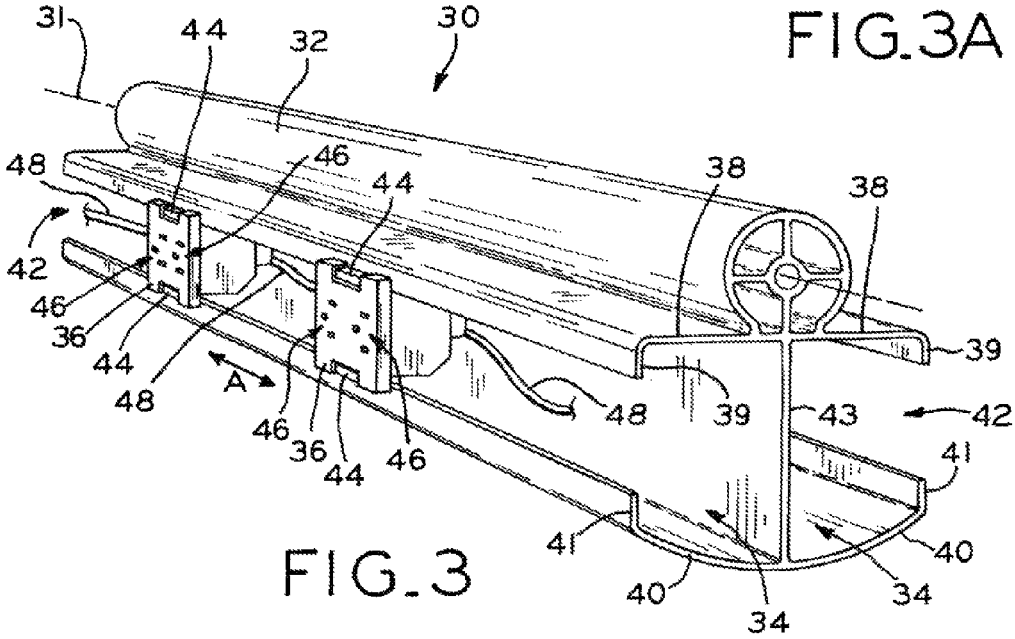
FIG. 3 is a perspective view of the channel of FIG. 2, further illustrating a plurality of snap-in electrical modules.

Referring now to FIGS. 2 and 3, channel 30 is shown and may be formed from an extruded aluminum material. Alternatively, channel 30 may be formed of a polymer material or a combination of polymer and metal. Channel 30 may integrally include cross bar 32 of table 20 which defines axis 31 about which rotation mechanism 28 (FIG. 1) rotates work surface 23 (FIG. 1) during rotation of work surface 23 between its horizontal and vertical positions, though cross bar 32 itself does not rotate. Channel 30 further defines at least one trough 34 between upper flange 38 and lower flange 40. Vertical upper flange 39 extends generally downward from upper flange 38 and vertical lower flange 41 extends generally upward from lower flange 40. Vertical upper flange 39 in combination with vertical lower flange 41 defines opening 42 which extends substantially along a longitudinal length of channel 30. Vertical support panel 43 extends from a central portion of lower flange 40 to a central portion of upper flange 38 and may provide a vertical barrier to define two separate troughs 34 as well as added support to channel 30. Each trough 34 on both sides of vertical support panel 43 may include identical features, such as vertical upper flange 39 and vertical lower flange 41.

Figure 5:
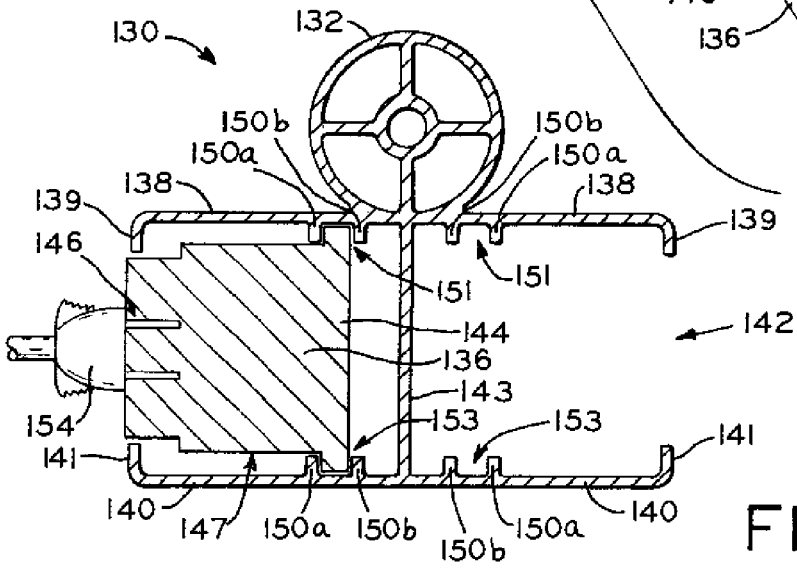
FIG. 5 is a cross-sectional view of the assembled channel and electrical harness assembly of FIG. 4.

As shown in FIG. 3, each electrical module 36 may include resilient tangs or buttons 44 on sides thereof which may include barbs for providing a snap-fit engagement with vertical upper flange 39 and vertical lower flange 41, as described below. Snap-in electrical module 36 further may include at least one electrical outlet 46 for receipt of electrical plug 154 (FIG. 5). To assemble channel 30 and a snap-in electrical module 36, a user may position electrical module 36 proximate opening 42 such that electrical outlet 46 faces away from channel 30. The user may depress resilient tangs 44 and then position electrical module 36 between upper flange 38 and lower flange 40 such that electrical module 36 is positioned within opening 42 between vertical upper flange 39 and vertical lower flange 41. The user may then release resilient tangs 44 to secure electrical module 36 in a desired position in channel 30. In another method, a user may position electrical module 36 proximate opening 42 such that electrical outlet 46 faces away from channel 30 and then the user may force electrical module 36 into channel 30. Resilient tangs 44 are biased inward upon contacting vertical upper flange 39 and vertical lower flange 41. Once electrical module 36 has been pushed further into channel 30, resilient tangs 44 are returned to an unbiased state such that electrical module 36 is securely positioned in channel 30. Electrical module 36 may also be slid along a direction substantially parallel to axis 31 by depressing resilient tangs 44 and manually sliding electrical module 36 within opening 42 along a general direction denoted by Arrow A until a desired position is determined. Resilient tangs 44 are then released and electrical module 36 is again secured in the desired position. Once resilient tangs 44 are released, electrical module 36 is retained in position relative to channel 30, thereby preventing sliding and radial movement relative to axis 31 of channel 30. Electrical modules 36 may be stand-alone electrical components which do not need any jumper connections. In another embodiment, electrical modules 36 are hard-wired electrical components which are joined together via electrical wires and/or cables 48 which provide power to electrical modules 36. In yet another embodiment, electrical modules 36 are attached via wires or extension cords to an existing outlet in a building or other structure in which table 20 is positioned to provide power to electrical modules 36.

As shown in FIG. 3A, in addition to, or in place of, electrical modules 36, communication modules 37 may also be used in a similar manner with channel 30. Communication modules 37 may be AMP-style data ports, such as telephone, cable, internet, or Ethernet connections, and include communication outlets 47 and resilient tangs 44. Communication module 37 may be positioned in channel 30 in similar ways as described above with respect to electrical modules 36. At least one communication module 37 and at least one electrical module 36 may be positioned in the same trough 34 or may be positioned in opposite troughs 34 on each side of vertical support panel 43.

In operation, as work surface 23 of table 20 is rotated from a vertical position (FIG. 1, solid lines) to a horizontal position (FIG. 1, dashed lines), channel 30 remains stationary such that openings 42 advantageously provide access to channel 30 which remains perpendicular to a ground surface upon which table 20 is positioned, i.e., upper flange 38 remains substantially parallel with the ground surface. Moreover, any cables or other electrical/communication cords, for example, cords/cables 48, that are positioned in troughs 34 are not twisted or otherwise interfered with during rotational movement of work surface 23. Further, openings 42 are optionally provided on either side of channel 30 to provide access to channel 30 on either side of table 20.

Figure 4:
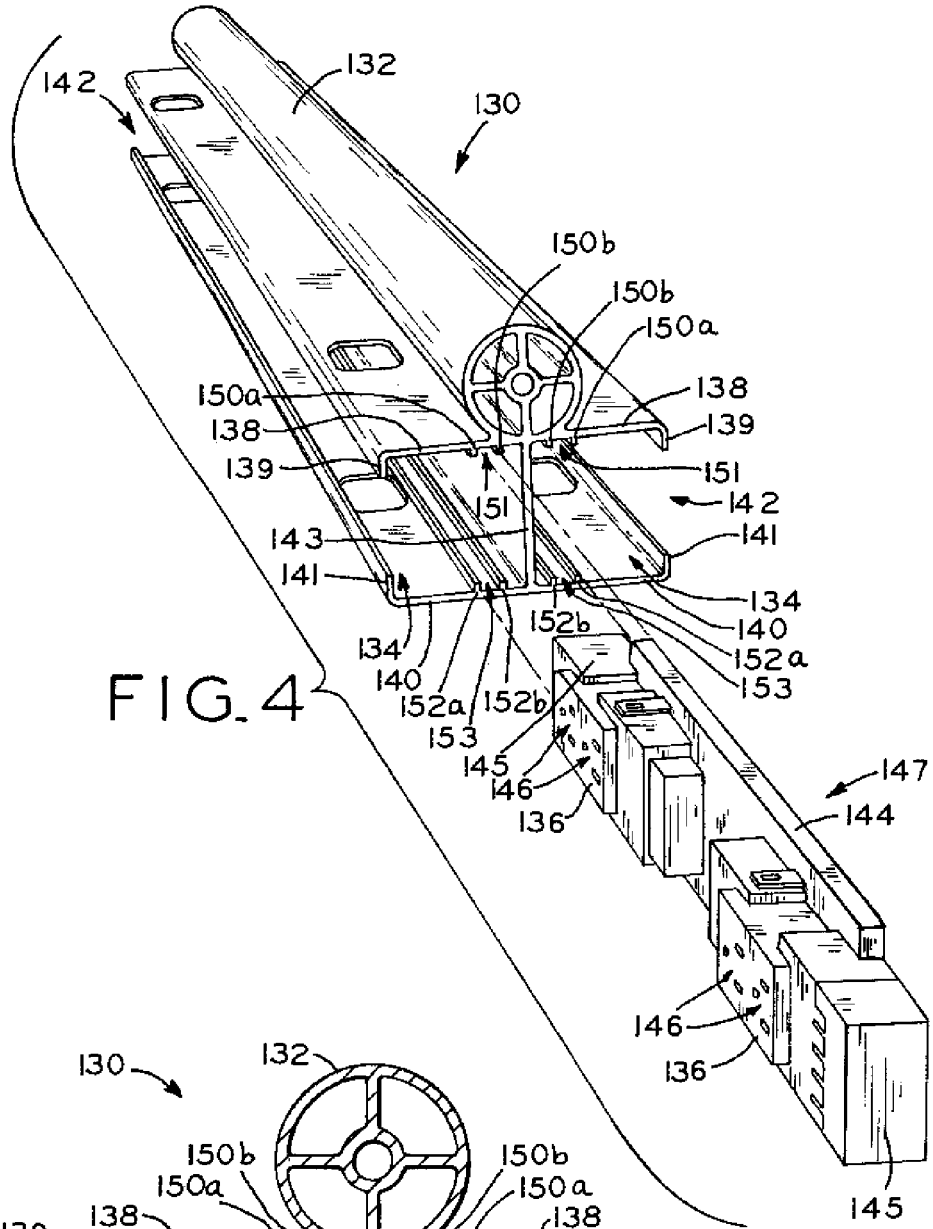
FIG. 4 is an exploded perspective view of a channel according to another embodiment of the present invention, further illustrating an electrical harness assembly exploded from the channel.

Referring now to FIGS. 4 and 5, channel 130 is shown and is substantially identical to channel 30, described above with reference to FIGS. 1-3, except as described below. Channel 130 generally includes cross bar 132, upper flange 138, and lower flange 140. Channel 130 may also include vertical support panel 143 extending between upper flange 138 and lower flange 140 to provide a vertical barrier to define two separate troughs 134 as well as added support to channel 130. Vertical upper flange 139 extends generally downward from upper flange 138 and vertical lower flange 141 extends generally upward from lower flange 140 to define opening 142 in channel 130. Upper vertical flanges 150*a*, 150*b* also extend generally downward from upper flange 138 and lower vertical flanges 152*a*, 152*b* extend generally upward from lower flange 140 to respectfully define channels 151, 153. Channels 151, 153 may be sized to slidingly receive at least a portion of electrical harness assembly 147 therein, as described below. Each trough 134 may include identical features, such as vertical upper flange 139, vertical lower flange 141, and channels 151, 153.

Electrical harness assembly 147 may include mounting board 144 formed as a rectangular piece of material on which at least one electrical connector 145 is mounted. Each electrical connector 145 may be releasably connected to at least one electrical module 136. Electrical modules 136 may each include at least one electrical outlet 146 for receipt of plug 154 (FIG. 5). Electrical harness assembly 147 may be slidably received and retained within channel 130 via interaction of mounting board 144 and channels 151, 153. Once mounting board 144 of electrical harness assembly 147 is positioned within channels 151, 153 of channel 130, electrical module 136 is exposed through opening 142 such that plug 154 may be easily inserted into outlet 146. An exemplary electrical system including electrical harness assembly 147 is an "8-10 Electrical System", available from Dekko Engineering, a Group Dekko Company, of Kendallville, Ind. Electrical modules 136 may be stand-alone electrical components which do not need any jumper connections. In another embodiment, electrical modules 136 are hard-wired electrical components which are joined together via electrical wires and/or cables, for example, cords/cables 48 (FIG. 3), which provide power to electrical modules 136. In yet another embodiment, electrical modules 136 are attached via wires or extension cords to an existing outlet in a building or other structure in which table 20 is positioned to provide power to electrical modules 136.

In addition to, or in place of, electrical modules 136, communication modules may also be used in a similar manner with channel 130. The communication modules may be AMP-style data ports, such as telephone, cable, internet, or Ethernet connections. The communication modules may be positioned in channel 130 in similar manners as described above with respect to electrical modules 136. At least one communication module and at least one electrical module 136 may be positioned in the same trough 134 or may be positioned in opposite troughs 134 on each side of vertical support panel 143.

Moreover, snap-in electrical modules 36 (FIG. 3) and communication modules 37 (FIG. 3A) can be used with channel 130 in a similar manner as each was used with channel 30 (FIGS. 1-3), as described above. For example, flanges 139 and 141 may cooperate to snap-fittingly engage modules 36 and/or modules 37 in a similar manner as flanges 39 and 41 (FIGS. 2 and 3), as described above.

Advantageously, channel 130 may be used in situations requiring either a "soft-wired" configuration in which the electrical modules are connected via extension cords or other cables to existing outlets in the building or other structure in which table 20 is positioned, or a "hard-wired" configuration in which the electrical modules are connected via contained power supplies and do not connect to existing outlets in the building or other structure. Thus, a manufacturer could incorporate channel 130 into table 20 and advantageously be able to sell table 20 to a buyer in a municipality which required "hard-wired" configurations only and equally to a buyer in a municipality which does not require "hard-wired" configurations.

Figure 6:
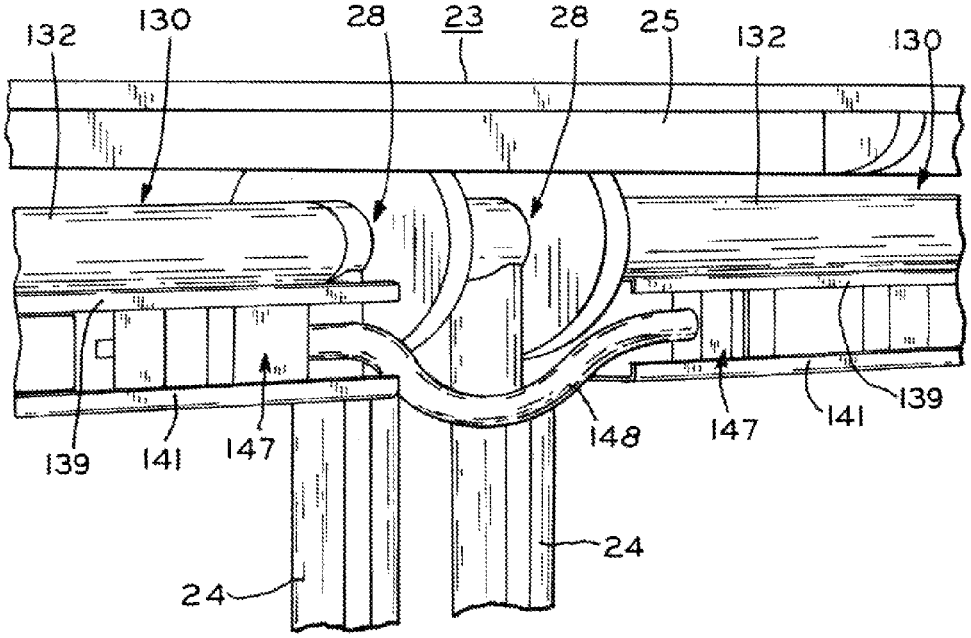
FIG. 6 is a perspective view of a portion of two tables, further illustrating an electrical jumper cable connecting electrical harness assemblies associated with each table.

As shown in FIG. 6, electrical jumper connection 148 may be employed between two tables 20 having respective electrical harness assemblies 147 mounted within channels 130. In another embodiment, electrical harness assemblies 147 are dedicated outlets without electrical jumper connections 148 being required between tables 20.

In operation, as work surface 23 (FIG. 1) of table 20 is rotated from a vertical position (FIG. 1, solid lines) to a horizontal position (FIG. 1, dashed lines), channel 130 advantageously remains stationary such that openings 142 provide access to channel 130 which remains perpendicular to a floor surface upon which table 20 is positioned, i.e., upper flange 138 remains substantially parallel with the floor surface. Moreover, advantageously, any cables or other electrical/communication cords, for example, cords/cables 48 (FIG. 3), that are positioned in troughs 134 are not twisted or otherwise interfered with during rotational movement of work surface 23. Further, openings 142 are optionally provided on either side of channel 130 to provide access to channel 130 on either side of table 20.

Figure 7:
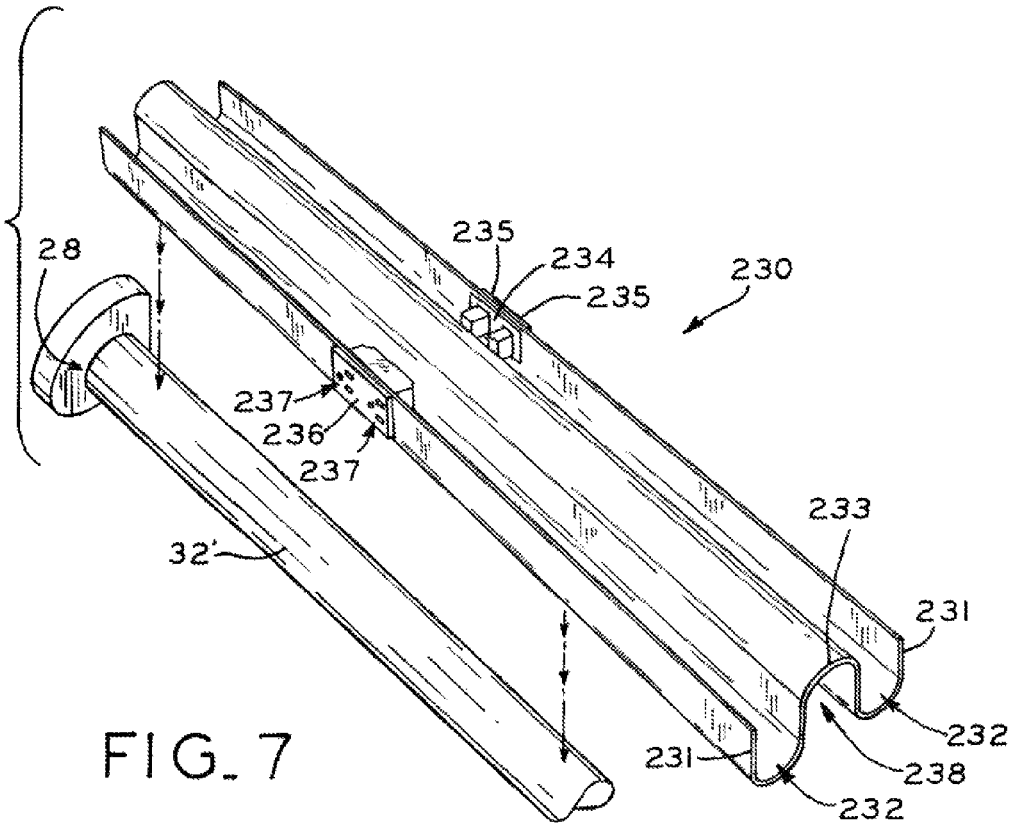
FIG. 7 is a perspective view of a channel according to yet another embodiment of the present invention.

Referring now to FIG. 7, another embodiment of a channel is shown as channel 230 and generally includes vertical sidewalls 231, troughs 232, and center U-shaped portion 233. Channel 230 may be formed from an extruded aluminum material, a polymer material, or a combination of polymer and metal. In another form, channel 230 may be formed from stamped metal, such as stainless steel which is rolled into the shape of channel 230, for example. Troughs 232 are generally defined between each vertical sidewall 231 and center portion 233. At least one cutout portion may be provided in each vertical sidewall 231 for receipt of various modules, as described below. The cutout portion may be provided in channel 230 via a laser cut or other suitable cutting method. Center portion 233 defines cross bar trough 238. In operation, cross bar horizontal member 32' of table 20 (FIG. 1) may be positioned in trough 238 and channel 230 may be snap-fittingly engaged therewith, thereby maintaining channel 230 on cross bar horizontal member 32' of table 20.

In one example, electrical module 236 may be mounted in a cutout portion in a vertical sidewall 231. Electrical module 236 may include at least one electrical outlet 237 which extends through the cutout portion beyond vertical sidewall 231 such that a user may easily access outlet 237. In another example, communication module 234 may be mounted in another cutout portion in a vertical sidewall 231. Communication module 234 may include at least one communication outlet 235 which extends through the cutout portion beyond vertical sidewall 231 such that a user may easily access outlet 235. Communication module 234 may be an AMP-style data port, such as a telephone, cable, internet, or Ethernet connection.

Although shown positioned in different vertical sidewalls 231, electrical module 236 and communication module 234 may be positioned on the same vertical sidewall 231. Furthermore, more than one electrical module 236 and communication module 234 may be positioned in cutout portions of vertical sidewalls 231.

In operation, as work surface 23 (FIG. 1) of table 20 is rotated from a vertical position (FIG. 1, solid lines) to a horizontal position (FIG. 1, dashed lines), channel 230 remains stationary such that the cutout portions provide orientation of electrical module 236 and communication module 234 perpendicular to a ground surface upon which table 20 is positioned, i.e., cross bar horizontal member 32' of table 20 rotates within cross bar trough 238 such that cross bar horizontal member 32' of table 20 rotates with respect to channel 230. Moreover, any cables or other electrical/communication cords, for example, cords/cables 48 (FIG. 3), that are positioned in troughs 232 are not twisted or otherwise interfered with during rotational movement of work surface 23. Further, the cutout portions are optionally provided on either side of channel 230 to provide access to channel 230 on either side of table 20.

While this invention has been described as having exemplary embodiments and scenarios, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A table, comprising:

a pair of spaced upright supports;

a work surface;

a pair of spaced rotation mechanisms positioned beneath said work surface at respective upper ends of said spaced upright supports, said work surface pivotable via said rotation mechanisms about a horizontal pivot axis between a horizontal position and a vertical position;

a channel disposed beneath said work surface when said work surface is in said horizontal position, said channel disposed between said rotation mechanisms, said channel including an upper horizontal flange, a vertical flange, and a lower horizontal flange, said flanges monolithically formed with one another, said flanges together defining at least one laterally facing opening and at least one trough, said channel remaining stationary during pivoting of said work surface between said horizontal position and said vertical position, said channel further comprising a structural beam disposed beneath said work surface, said channel disposed below and monolithically formed with said structural beam, further wherein said structural beam defines said horizontal pivot axis; and at least one electrical component removably mounted within said channel, said trough receiving said electrical component and said laterally facing opening providing access to said electrical component.

2. The table of claim 1, wherein said upper horizontal flange includes first and second downwardly extending flanges defining a first guidance channel extending along said channel and said lower horizontal flange includes first and second upwardly extending flanges defining a second guidance channel extending along said channel, said electrical component comprising an electrical harness assembly separate from said channel and including an upper portion and a lower portion, said first guidance channel sized to receive said upper portion, said second guidance channel sized to receive said lower portion, said upper portion slidably received along said first guidance channel and said lower portion slidably received along said second guidance channel.

3. The article of furniture of claim 1, wherein said electrical component is snap-fittingly engaged within said channel.

4. The table of claim 1, wherein said electrical component is positioned substantially within said trough and extending at least partially through said opening.

5. The article of furniture of claim 1, further comprising a communication component, said communication component removably attached to said table.

6. The article of furniture of claim 5, wherein said channel defines said at least one trough as a first trough and a second trough, said electrical component positioned substantially within said first trough and said communication component positioned substantially within said second trough.

7. The article of furniture of claim 5, wherein said channel defines at least one trough, said electrical component and said communication component positioned substantially within said trough.

8. The article of furniture of claim 1, wherein said channel includes at least one cutout portion for receiving said electrical component.

9. The table of claim 1, wherein said electrical component comprises a hard-wired electrical module.

* * * * *